US005950311A

United States Patent [19]

Huang

[11] Patent Number: 5,950,311

[45] Date of Patent: Sep. 14, 1999

[54] KNIFE HAVING AN EASILY ASSEMBLING STRUCTURE

[76] Inventor: Yin Han Huang, P.O. Box 63-99, Taichung, Taiwan

[21] Appl. No.: 09/061,436

[22] Filed: Apr. 14, 1998

[51] Int. Cl.[6] ..... B26B 1/00

[52] U.S. Cl. ..... 30/162; 30/335

[58] Field of Search ..... 30/162, 320, 329, 30/335, 336, 337

[56] References Cited

U.S. PATENT DOCUMENTS

| | | | |
|---|---|---|---|
| 4,586,256 | 5/1986 | Weimann | 30/162 |
| 4,663,845 | 5/1987 | Weimann | 30/162 |
| 4,939,839 | 7/1990 | Gorst | 30/162 X |
| 5,099,578 | 3/1992 | Jan | 30/162 |
| 5,121,544 | 6/1992 | Gilbert | 30/162 |
| 5,303,469 | 4/1994 | Yin-Han | 30/2 |
| 5,813,121 | 9/1998 | Gringer | 30/162 |

*Primary Examiner*—Rinaldi I. Rada
*Assistant Examiner*—T. Anthony Vaughn

[57] ABSTRACT

A knife includes two casings for slidably supporting a knife blade. The casings includes a structure that may be easily assembled together without additional tools. The casings each includes a latch formed on one end for engaging with each other and for securing one end of the casings together. A knob is slidably engaged on one of the casings and includes a hook for engaging with the other casing and for securing the casings together. A spring may bias the hook to engage with an engaging recess of the other casing.

1 Claim, 4 Drawing Sheets

KNIFE HAVING AN EASILY ASSEMBLING STRUCTURE

BACKGROUND OF THE INVENTION

1. Field of the Invention

The present invention relates to a knife, and more particularly to a utility knife having an easily assembling structure.

2. Description of the Prior Art

A typical utility knife is disclosed in U.S. Pat. No. 5,303,469 to Huang and comprises a pair of casings secured together by fasteners, such as screws. An additional tool is required for assembling the casings together, such that the user may not easily secure the casings together when no tool is available.

The present invention has arisen to mitigate and/or obviate the afore-described disadvantages of the conventional utility knives.

SUMMARY OF THE INVENTION

The primary objective of the present invention is to provide a utility knife having a structure that may be easily assembled and disassembled without additional tools.

In accordance with one aspect of the invention, there is provided a knife comprising a body for supporting a knife blade, the body including a first casing and a second casing, the first casing and the second casing each including a first end having a latch engaged with each other for securing the first ends of the first casing and the second casing together, the first casing including an engaging recess, a knob slidably engaged on the second casing and including a hook for engaging with the engaging recess of the first casing and for securing the second casing to the first casing, and means for biasing the hook to engage with the engaging recess.

The first casing includes a projection extended inward thereof, the engaging recess is formed in the projection. The projection includes a tapered surface, the hook, includes a tapered surface for engaging with the tapered surface of the projection and for allowing the hook to be moved to engage with the engaging recess against the biasing means.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
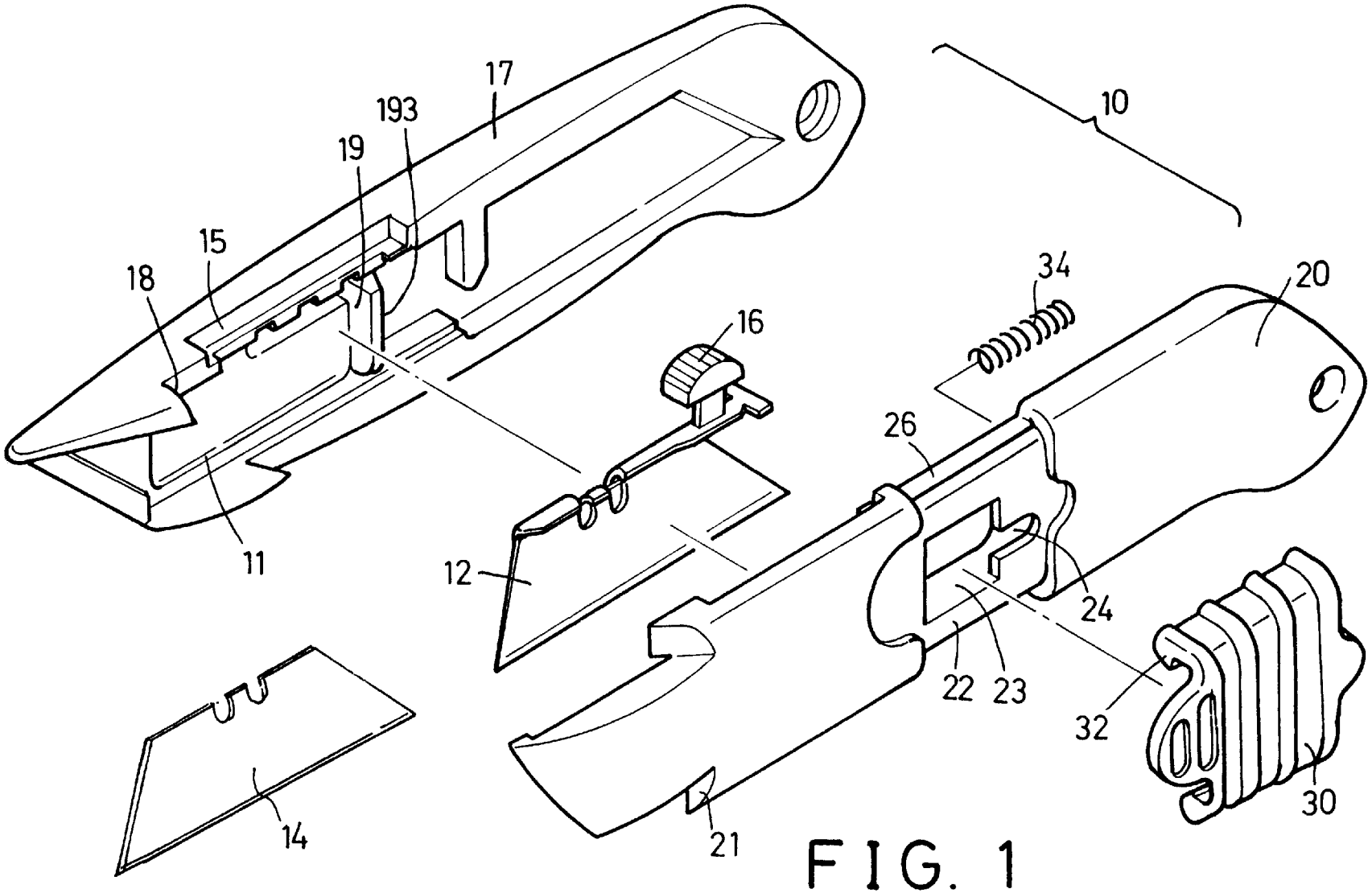
FIG. 1 is an exploded view of a knife in accordance with the present invention.
Figure 2:
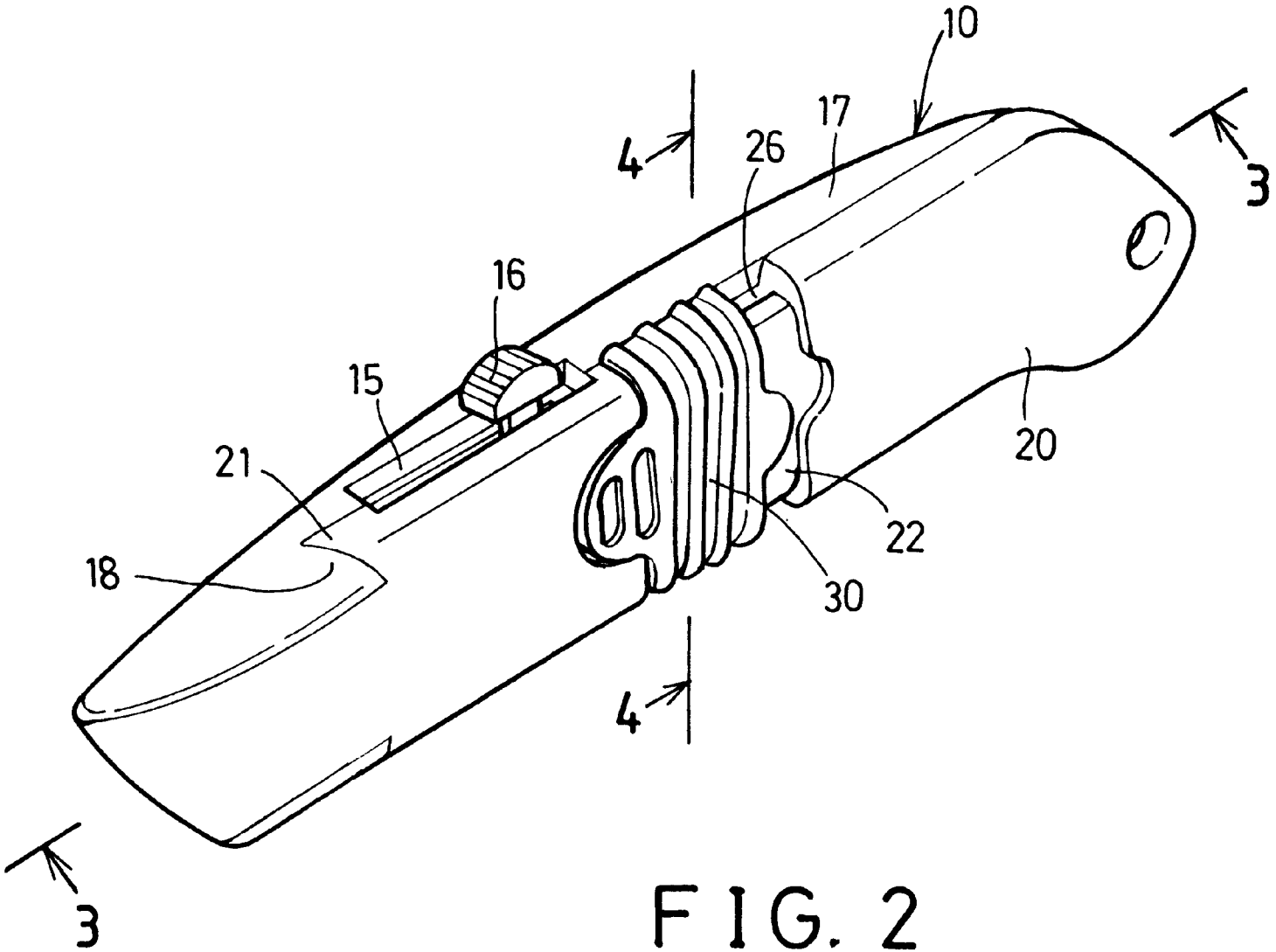
FIG. 2 is a perspective view of the knife.

Referring to the drawings, and initially to FIGS. 1–4, a knife in accordance with the present invention comprises a body 10 including a groove 11 for slidably receiving a holder 12 which is used for securing a knife blade 14 and which includes a button 16 extended outward through a slot 15 of the body 10 for allowing the button 16 to move the knife blade 14 inward and outward of the body 10. The body 10 includes two casings 17, 20 each having a latch 18, 21 formed in the front end for engaging with each other and for securing the front portions of the casings 17, 20 together. The casing 17 includes a projection 19 extended inward from the middle portion and having an engaging recess 191 and having a tapered surface 193.

The other casing 20 includes a channel 22 for slidably receiving a knob 30 and includes a pair of shoulders 26. The knob 30 includes a pair of flanges 32 for slidably engaging with the shoulders 26 and for preventing the knob 30 from being disengaged from the casing 20. The casing 20 includes an opening 23 and a notch 24 communicating with the opening 23 and for engaging with a spring 34. The knob 30 includes a bulge 31 extended inward through the opening 23 and includes a stud 33 for engaging with the spring 34 which is engaged between the knob 30 and the casing 20. The bulge 31 includes a hook 38 biased to engage with the engaging recess 191 of the projection 19 of the casing 17. The hook 38 includes a tapered surface 382 for engaging with the tapered surface 193 of the projection 19.

Figure 3:
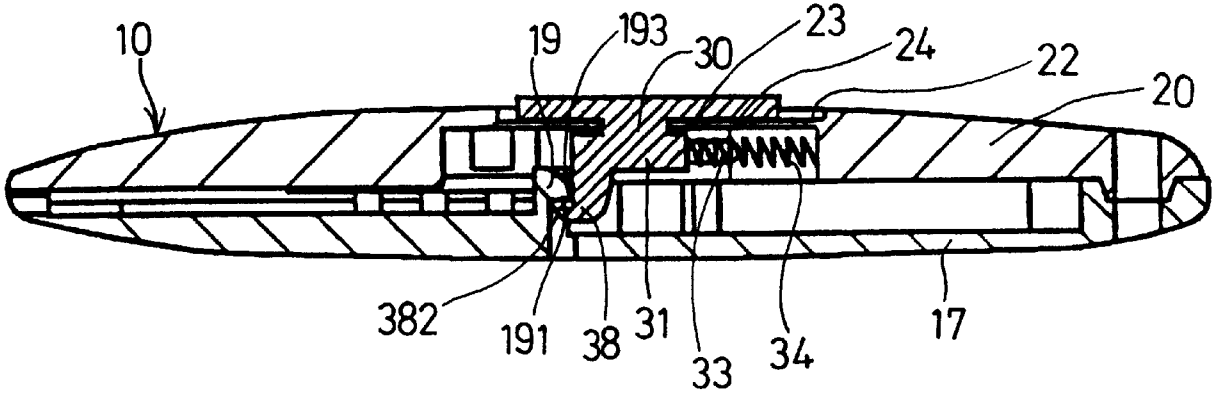
FIG. 3 is a cross sectional view taken along lines 3—3 of FIG. 2.
Figure 4:
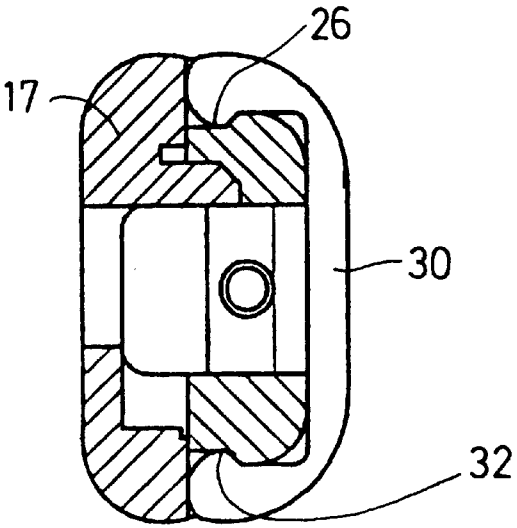
FIG. 4 is a cross sectional view taken along lines 4—4 of FIG. 2.
Figure 5:
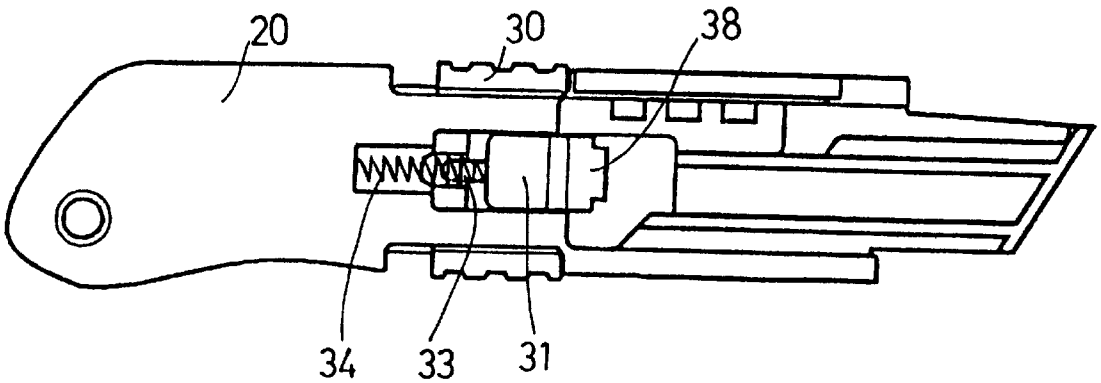

When it is required to assemble the two casings 17, 20 together, the latches 18, 21 of the casings 17, 20 are first engaged with each other. The casings 17, 20 are then forced toward each other. At this moment, the tapered surface 382 of the hook 38 may engage with and slip over the tapered surface 193 of the projection 19 and the knob 30 may be forced to move against the spring 34 for allowing the hook 38 to engage with the engaging recess 191 of the projection 19 and for allowing the casings 17, 20 to be easily and quickly assembled together (FIGS. 3, 5).

Figure 6:
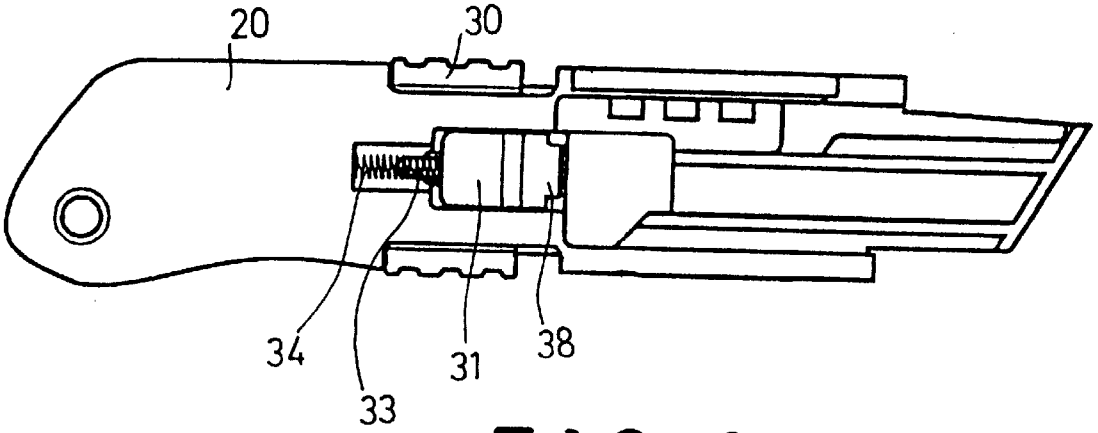
FIGS. 5 and 6 are schematic views illustrating the operation of the knife.

When it is required to separate the casings 17, 20 from each other, as shown in FIG. 6, it is only required to move the knob 30 against the spring 34 for disengaging the hook 38 from the engaging recess 191. The casings 17, 20 may thus be easily separated from each other.

Accordingly, the knife in accordance with the present invention includes a structure that may be easily assembled and disassembled without additional tools.

Although this invention has been described with a certain degree of particularity, it is to be understood that the present disclosure has been made by way of example only and that numerous changes in the detailed construct ion and the combination and arrangement of parts may be resorted to without departing from the spirit and scope of the invention as hereinafter claimed.

I claim:

1. A knife comprising:

a body for supporting a knife blade, said body including a first casing and a second casing, said first casing and said second casing each including a first end having a latch engaged with each other for securing said first ends of said first casing and said second casing together, said first casing including a middle portion having a projection extended inward thereof and including an engaging recess formed in said projection, said projection including a tapered surface formed therein, said second casing including an opening and a notch formed therein and communicating with each other, said second casing including a channel formed therein, a knob slidably engaged in said channel of said second casing and including a bulge extended inward through said opening of said second casing and including a hook for engaging with said engaging recess of said projection of said first casing and for securing said second casing to said first casing, said hook including a tapered surface formed therein for engaging with said tapered surface of said projection and for allowing said hook to be moved to engage with said engaging recess, and a biasing means engaged with said knob for biasing said hook of said knob to engage with said engaging recess of said projection and to lock said first casing and said second casing together.

* * * * *